US006547107B2

(12) United States Patent
Hiramoto et al.

(10) Patent No.: US 6,547,107 B2
(45) Date of Patent: Apr. 15, 2003

(54) FILLING AMOUNT ADJUSTMENT DEVICE FOR A LIQUID-FORM SUBSTANCE FILLING MACHINE

(75) Inventors: Shinichi Hiramoto, Iwakuni (JP); Kenji Kawamura, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 0 days.

(21) Appl. No.: 10/007,948

(22) Filed: Dec. 5, 2001

(65) Prior Publication Data

US 2002/0066754 A1 Jun. 6, 2002

(30) Foreign Application Priority Data

Dec. 6, 2000 (JP) ..... 2000-370967

(51) Int. Cl.[7] ..... B65D 88/54
(52) U.S. Cl. ..... 222/309; 222/380
(58) Field of Search ..... 222/309, 380, 222/383.1, 333

(56) References Cited

U.S. PATENT DOCUMENTS 1,794,388 A 3/1931 Mojonnier et al.
2,032,163 A * 2/1936 Bagby ..... 222/309
3,873,007 A * 3/1975 Christine et al. ..... 222/383.1
4,234,107 A 11/1980 Gernlein

FOREIGN PATENT DOCUMENTS

| | | |
|---|---|---|
| GB | 820 159 | 9/1959 |
| JP | S62-40882 | 10/1987 |
| JP | H5-44801 | 2/1993 |

* cited by examiner

*Primary Examiner*—Philippe Derakshani
(74) *Attorney, Agent, or Firm*—Koda & Androlia

(57) ABSTRACT

A filling amount adjustment device for a liquid-form substance filling machine, the device including first sliding units disposed on a swing arm and connecting links pivotally attached at one ends to connecting pins of first sliding members (of the first sliding units) that slide along the length of the arm. Second sliding units are disposed on both sides of the swing arm, and the other ends of the connecting links are pivotally connected to the connecting pins of second sliding members (of the second sliding units). Connecting rods connected to piston rods are pivotally connected to the connecting pins. When fine adjustment shafts in which male screws are cut are rotated, the second sliding members are moved and positioned; as a result, the first sliding members slide via the connecting links, thus changing the positions of the connecting pins in the direction of length of the arm.

6 Claims, 10 Drawing Sheets

FILLING AMOUNT ADJUSTMENT DEVICE FOR A LIQUID-FORM SUBSTANCE FILLING MACHINE

BACKGROUND OF THE INVENTION

1. Field of the Invention

The present invention relates to a filling amount adjustment device that controls the amount of filling in a liquid-form substance filling machine that supplies a liquid-form substance via filling nozzles to bags held in an automated packaging machine.

2. Prior Art

Japanese Utility Model Application Publication (Kokoku) No. S62-40882 discloses a liquid-form substance filling machine that includes a storage tank for a liquid-form substance, a switch-over valve, a filling nozzle, a filling cylinder, etc. In this liquid-form substance filling machine, the piston rod of the filling cylinder is raised and lowered via a crank driving section and an L-shaped lever. A predetermined amount of a liquid-form substance is supplied into the filling cylinder, and then the liquid-form substance is discharged from the filling cylinder and then released out of the filling nozzle.

The above liquid-form substance filling machine further includes a rough adjustment mechanism and a fine adjustment mechanism for the filling amount. The rough adjustment mechanism is installed in the crank driving section. It adjusts the pivot angle of the L-shaped lever with the attachment position of the crank pin being adjustable in the radial direction by a screw. The fine adjustment mechanism is installed on the L-shaped lever. It adjusts the distance from the pivoting center with the attachment position of a connected rod connected to the piston rod being freely adjustable in the direction of length of the lever by a screw. The attachment positions of the respective adjustment mechanisms are adjusted by manually turning knobs that are attached to the end portions of the screws.

Japanese Utility Model Application Laid-Open (Kokai) No. H05-44801 discloses an improvement of the above-described fine adjustment mechanism. Instead of turning the screw by a knob, a gear is attached to the end portion of the screw, and this gear is driven by a motor that has a speed reduction gear and is disposed on the L-shaped lever.

The adjustment by the above-described rough adjustment mechanism is performed when the filling amount changes. This adjustment is ordinarily performed while the automated packaging machine and filling machine are stopped. However, the adjustment by the fine adjustment assembly is often performed while the system is in operation. In other words, fine adjustment is performed when variation in the filling amount that accompanies changes in the properties (viscosity and temperature) of the liquid-form substance during operation is corrected. Fine adjustment is also performed when the filling amount is accurately set while sampling is performed in the case of a change in the type of liquid-form substance that is to be handled.

However, in the filling amount adjustment device described in Japanese Utility Model Publication (Kokoku) No. S62-40882, the L-shaped lever constantly swings during the operation of the filling machine. Thus, it is actually very dangerous and practically impossible to adjust the filling amount by manually turning the knob of the fine adjustment assembly. As a result, not only is there a drop in the working efficiency, i.e., a drop in productivity, but it is also extremely difficult to obtain an accurate filling amount.

On the other hand, in the filling amount adjustment device described in Japanese Utility Model Application Kokai (Laid-Open) No. H05-44801, the fine adjustment assembly is driven by a motor that is equipped with a speed reduction gear. This device is advantageous in that fine adjustment is done even during the operation of the filling machine.

However, if the motor equipped with a speed reduction gear is disposed on the L-shaped lever in the configuration described in the above-described Japanese Utility Model Publication (Kokoku) No. S62-40882, the motor is positioned directly beneath the filling cylinder. As a result, a motor trouble would easily occur by a leaking liquid.

Furthermore, the moving element increases in size, and the space available for avoiding interference with other elements inside the machine becomes insufficient (the crank driving section and L-shaped lever, etc., are accommodated inside a cramped machine base together with the driving mechanism and control device of the packaging machine proper). Especially for a multi-unit type packaging machine (in which a plurality of bags are simultaneously supplied, and respective packaging is successively performed on a plurality of bags at the same time in order to improve productivity), it is necessary to install an L-shaped lever, on which a motor equipped with a speed reduction gear is disposed, for the piston rod of each one of the filling cylinders. As a result, the problem of insufficient space inside the machine base becomes even more critical. In addition, since the installed plurality of heavy motors make swing movements, the load on the crank driving section and on the driving force transmission mechanism is extremely large.

SUMMARY OF THE INVENTION

Accordingly, the present invention is to solve the above-described problems with the conventional devices.

It is thus an object of the present invention to provide a filling amount adjustment device that allows adjustment of the filling amount even while the filling machine is in operation.

It is another object of the present invention to provide a filling amount adjustment device that is free of an excessively large installation space even when used in a multi-unit type packaging machine.

It is still another object of the present invention to provide a filling amount adjustment device that prevents excess load on the drive section and transmission mechanism.

The above objects are accomplished by a unique structure for a filling amount adjustment device used in a liquid-form substance filling machine in which a piston rod is caused to advance and retract by an arm that is connected to a drive section and makes a swing movement, a piston is caused to advance and retract inside a filling cylinder by the piston rod, a predetermined amount of a liquid-form substance is supplied into the filling cylinder, and the liquid-form substance is discharged from the filling cylinder and then released out of a filling nozzle; and the filling amount adjustment device of the present invention comprises:

- a first sliding member provided on the arm so that the first sliding member swings together with the arm and slides in a direction of length of the arm, the first sliding member being connected to the piston rod via a connecting member,
- a second sliding member which slides in a direction perpendicular to a supporting shaft of the arm and stops at appropriate positions, and a position regulating member which is provided on the second sliding member and is moved by a sliding movement of the second sliding member, the position regulating member being connected to the first sliding member and guiding a swing movement of the first sliding member along a predetermined path, wherein the position of the first sliding member with respect to the direction of length of the arm is adjusted by way of sliding the second sliding member and thus moving the position regulating member.

In a desirable configuration of the present invention, the position regulating member is a connecting link, one end of this connecting link is pivotally connected to the first sliding member, and another and of this connecting link is pivotally attached to the second sliding member. Alternatively, the position regulating member can be a grooved cam. This position regulating member or the grooved cam is connected to the first sliding member via a cam roller which rolls in the groove of the grooved cam.

Furthermore, the present invention is applicable to a multi-unit type liquid-form substance filling machine which is equipped with a plurality of filling cylinders and filling nozzles. In this case, a plurality of first sliding members are installed on a single arm, and the second sliding members and position regulating members are installed so as to correspond to the respective first sliding members. The positioning of the plurality of second sliding members is accomplished for each one of the second sliding members.

DETAILED DESCRIPTION OF THE INVENTION

The filling amount adjustment device for a liquid-form substance filling machine provided by the present invention will be described in concrete terms below with reference to FIGS. 1 through 10.

Figure 1:
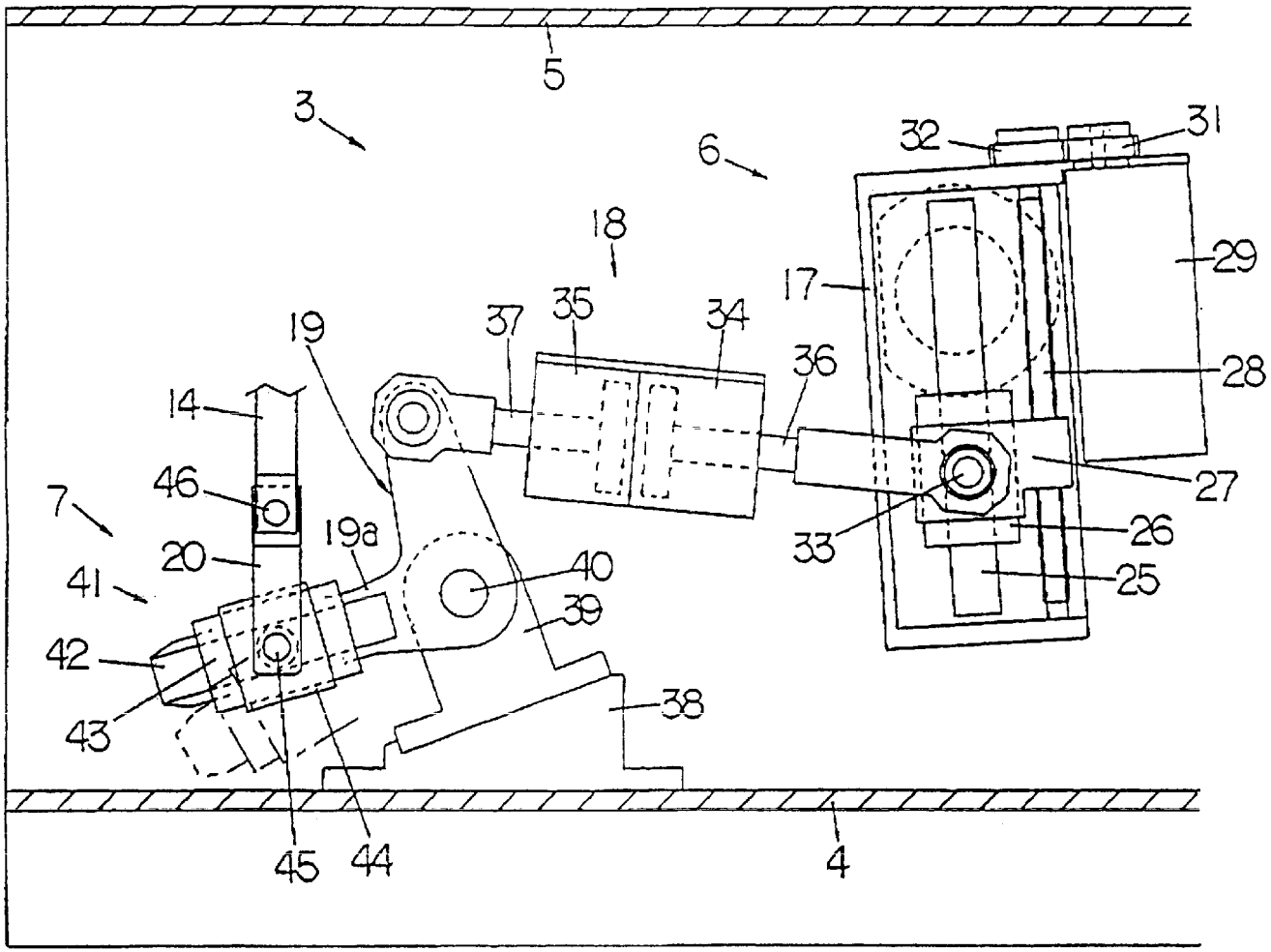
FIG. 1 is a side view of the driving force transmission section of the liquid-form substance filling machine of the present invention.
Figure 2:
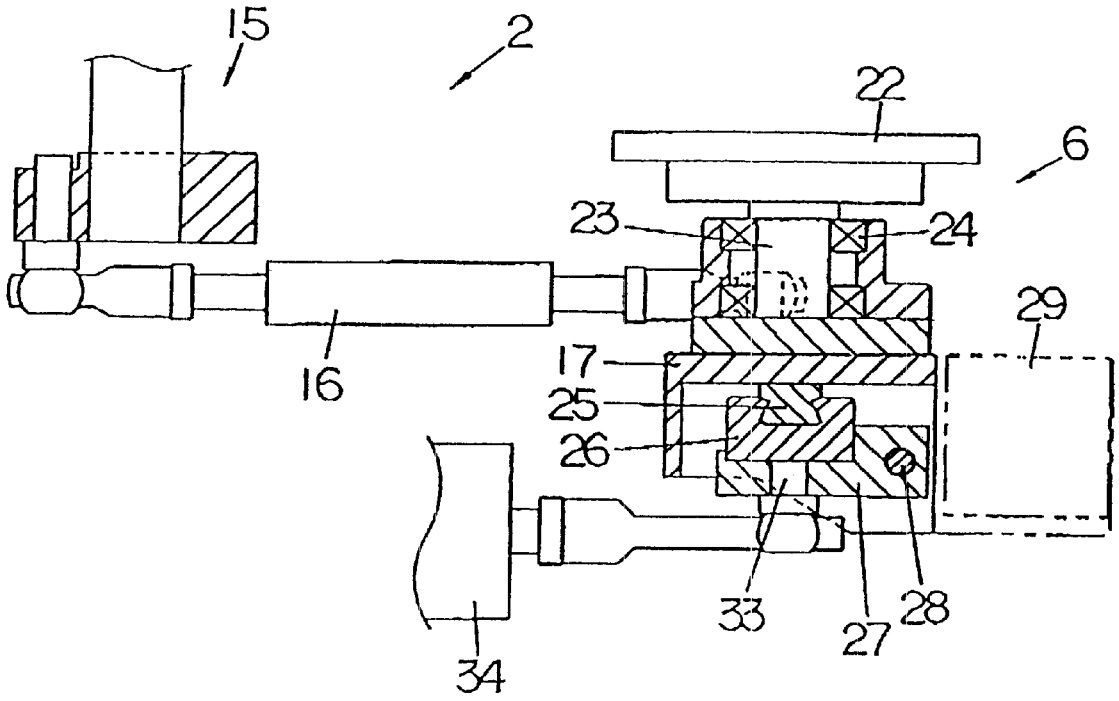
FIG. 2 is a top view, in cross section, of the drive section and filling amount rough adjustment assembly of the liquid-form substance filling machine.
Figure 3:
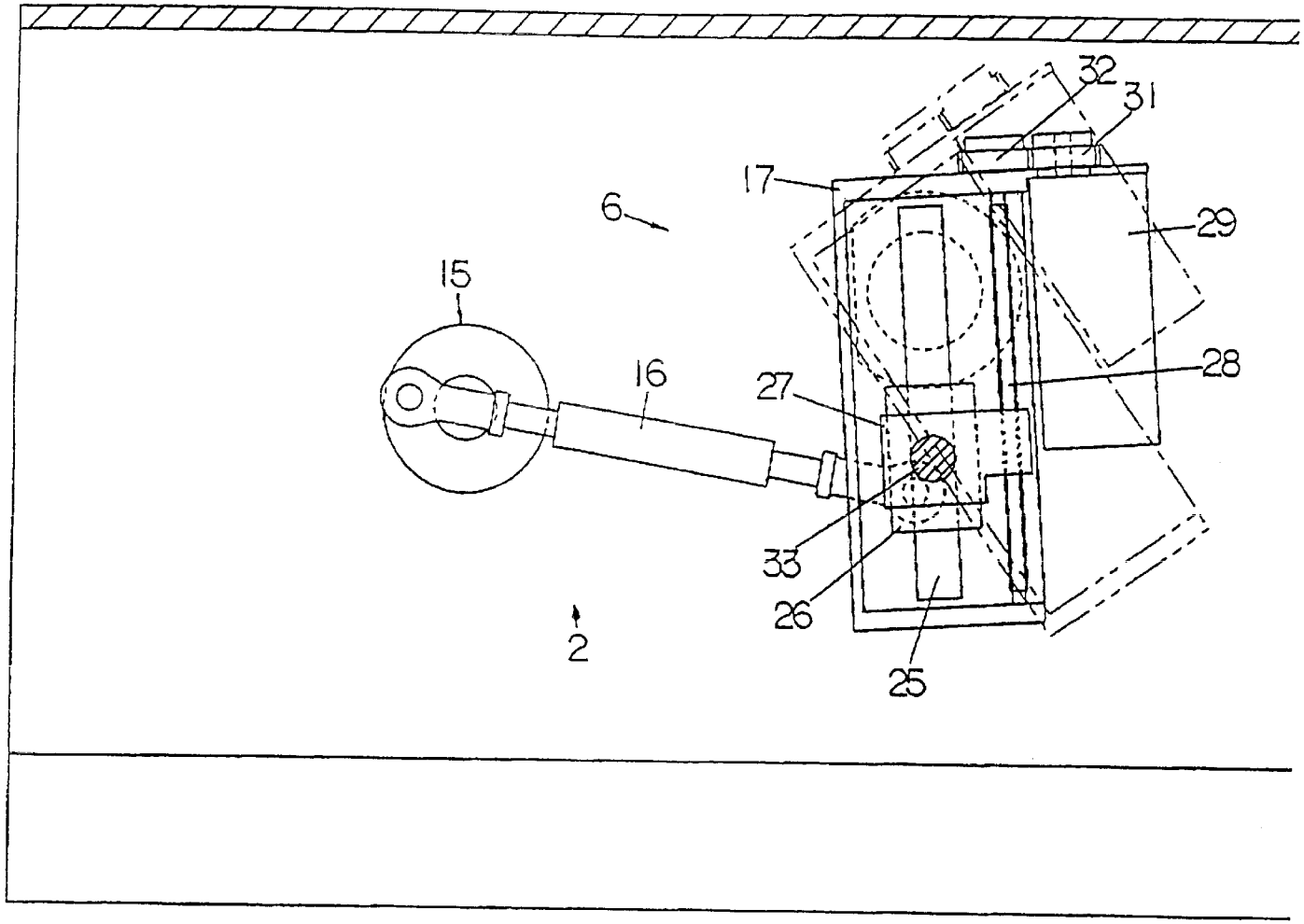
FIG. 3 is a side view of the drive section and filling amount rough adjustment assembly thereof.
Figure 8:
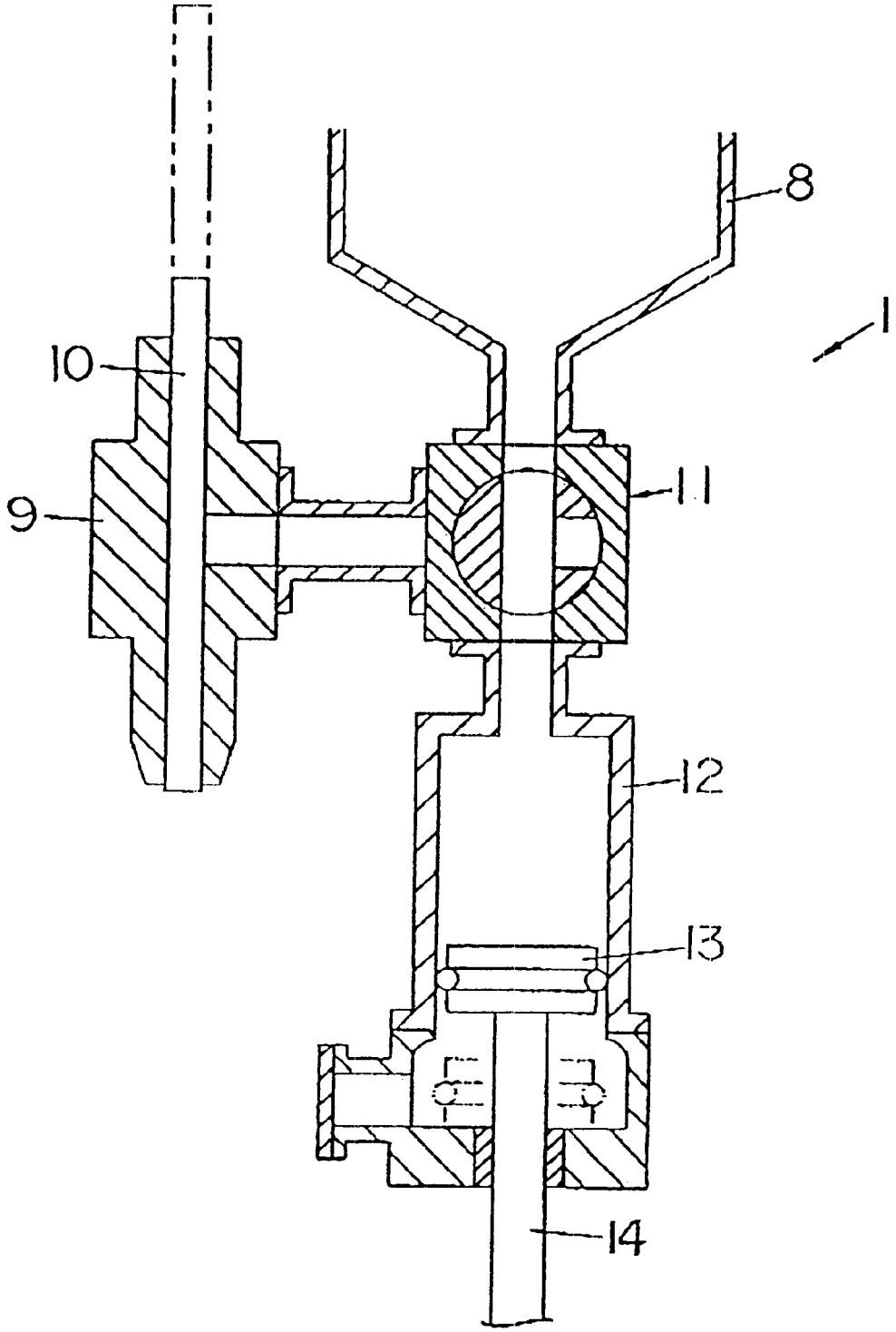
FIG. 8 is a sectional view of the filling section of the liquid-form substance filling machine.

The liquid-form substance filling machine comprises a filling section 1 shown in FIG. 8, a crank driving section 2 shown in FIGS. 2 and 3, etc., and a driving force transmission section 3 shown as a whole in FIG. 1.

The crank driving section 2 and the driving force transmission section 3 are accommodated inside a machine base (in the space between a machine base bottom plate 4 and machine base top plate 5). A rough adjustment assembly 6 and a fine adjustment assembly 7 are disposed in the driving force transmission section 3. The fine adjustment assembly 7 corresponds to the liquid-form substance adjustment device of the present invention. The liquid-form substance filling machine will be described with reference to a two-unit type machine.

As seen from FIG. 8, the filling section 1 comprises a storage tank 8, a filling nozzle 9, a piston plug 10, a switch-over valve 11, a filling cylinder 12, a piston 13, a piston rod 14, etc. The piston rod 14A makes an upward and downward movement. As a result, a predetermined amount of a liquid-form substance is taken into the filling cylinder 12 from the storage tank 8 via the switch-over valve 11, and then the liquid-form substance passes through the switch-over substance.

As shown in FIGS. 2 and 3, the crank driving section 2 is comprised of a crank mechanism 15 that is caused to rotate continuously by a driving source (not shown), and a connecting rod 16. The tip end of the connecting rod 16 is connected to a swing frame 17 that forms a part of the driving force transmission section 3 (or the rough adjustment assembly 6), so that the connecting rod 16 is free to pivot. Furthermore, as seen from FIG. 1, the driving force transmission section 3 is comprised of the rough adjustment assembly 6, a transmission control section 18, an L-shaped swing arm 19, the fine adjustment assembly 7, a connecting member 20 and other elements (not shown). The driving force from the crank driving section 2 is transmitted to the piston rod 14 via the above elements, thus raising and lowering the piston rod 14.

As seen from FIGS. 1 through 3, the rough adjustment assembly 6 is comprised of, together with other elements, a swing supporting shaft 23 which is fastened to an attachment plate 22 on the machine base bottom plate 4. A swing frame 17 of the rough adjustment assembly 6 is shaft-supported via a bearing 24 so that the swing frame 17 pivots about the swing supporting shaft 23. The rough adjustment assembly 6 further includes a slide rail 25 that is provided inside the swing frame 17 and a sliding block 26 that slides on the slide rail 25. A sliding member 27 is fastened to the sliding block 26, and a female screw is formed in the sliding member 27 so as to be parallel to the slide rail 25. A rough adjustment shaft 28 of the rough adjustment assembly 6 is provided so as to be rotatable in the swing frame 17. A male screw that engages with the female screw of the sliding member 27 is formed on the rough adjustment shaft 28. A rough adjustment servo motor 29 is attached to the outer wall of the swing frame 17 of the rough adjustment assembly 6. The drive gear 31 of the servo motor 29 engages with a driven gear 32 that is coupled to the upper end of the adjustment shaft 28. Furthermore, a connecting shaft 33 is attached to the sliding member 27 in a direction parallel to the swing supporting shaft 23.

When the servo motor 29 is actuated and rotates the rough adjustment shaft 28, the sliding member 27 moves on the slide rail 25. As a result, the distance between the swing supporting shaft 23 that constitutes the center of swing of the swing frame 17 and the connecting shaft 33 that constitutes a connecting part with the transmission control section 18 is adjusted. The swing angle of the swing arm 19 is thus adjusted.

As seen from FIG. 1, the transmission control section 18 is comprised of a first air cylinder 34 which is used for overload prevention and a second air cylinder 35 which is actuated during cleaning. The air cylinders 34 and 35 are fastened on their backs. The tip end of the piston rod 36 of the first air cylinder 34 is pivotally connected to the connecting shaft 33, and the tip end of the piston rod 37 of the second air cylinder 35 is pivotally connected to one end of the swing arm 19. Normally, the piston rods 36 and 37 are in a retracted state in the first and second air cylinders 34 and 35.

However, in a case of trouble that the piston plug 10, for instance, fails to open during the liquid-form substance discharge process, so that a load exceeding a certain fixed value is applied to respective parts of this liquid-form substance filling machine, the piston rod 36 is extended against the driving force by this load, thus absorbing any excessive load. It is also possible, at the same time, to stop the operation of the liquid-form substance filling machine. Thus, the first air cylinder 34 functions as a safety device and a detection device. Furthermore, during cleaning, the piston rod 37 of the second air cylinder 35 is extended, so that the swing arm 19 is inclined even further (as shown by the imaginary dotted line in FIG. 1), thus lowering the piston 14 to the position shown by the imaginary dotted line in FIG. 8. As a result, cleaning can be performed without removing the piston 14. Still, the cleaning can be performed with the piston 14 removed.

Figure 4:
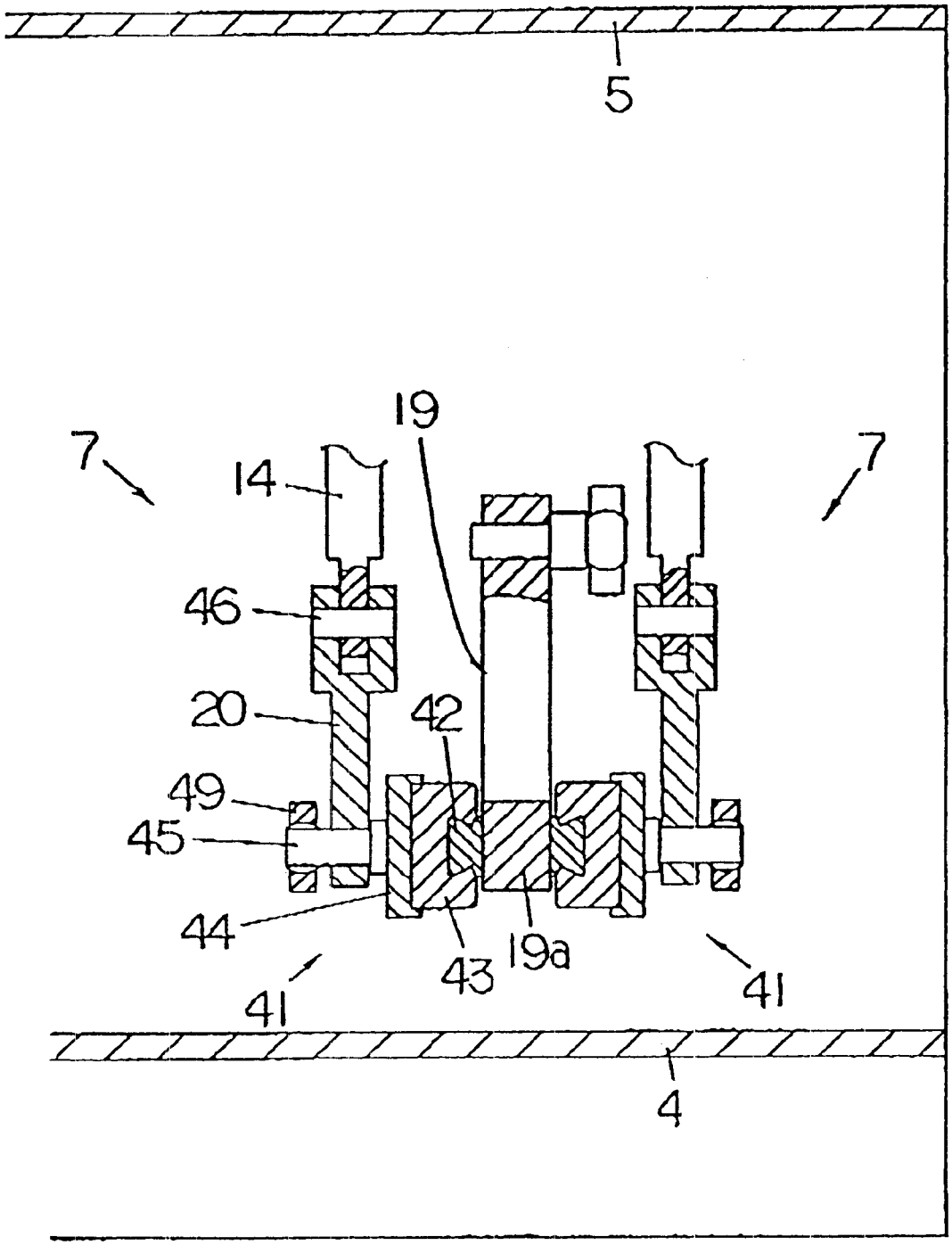
FIG. 4 is a front view, in cross section, of the first sliding units of the filling amount fine adjustment assemblies.
Figure 5:
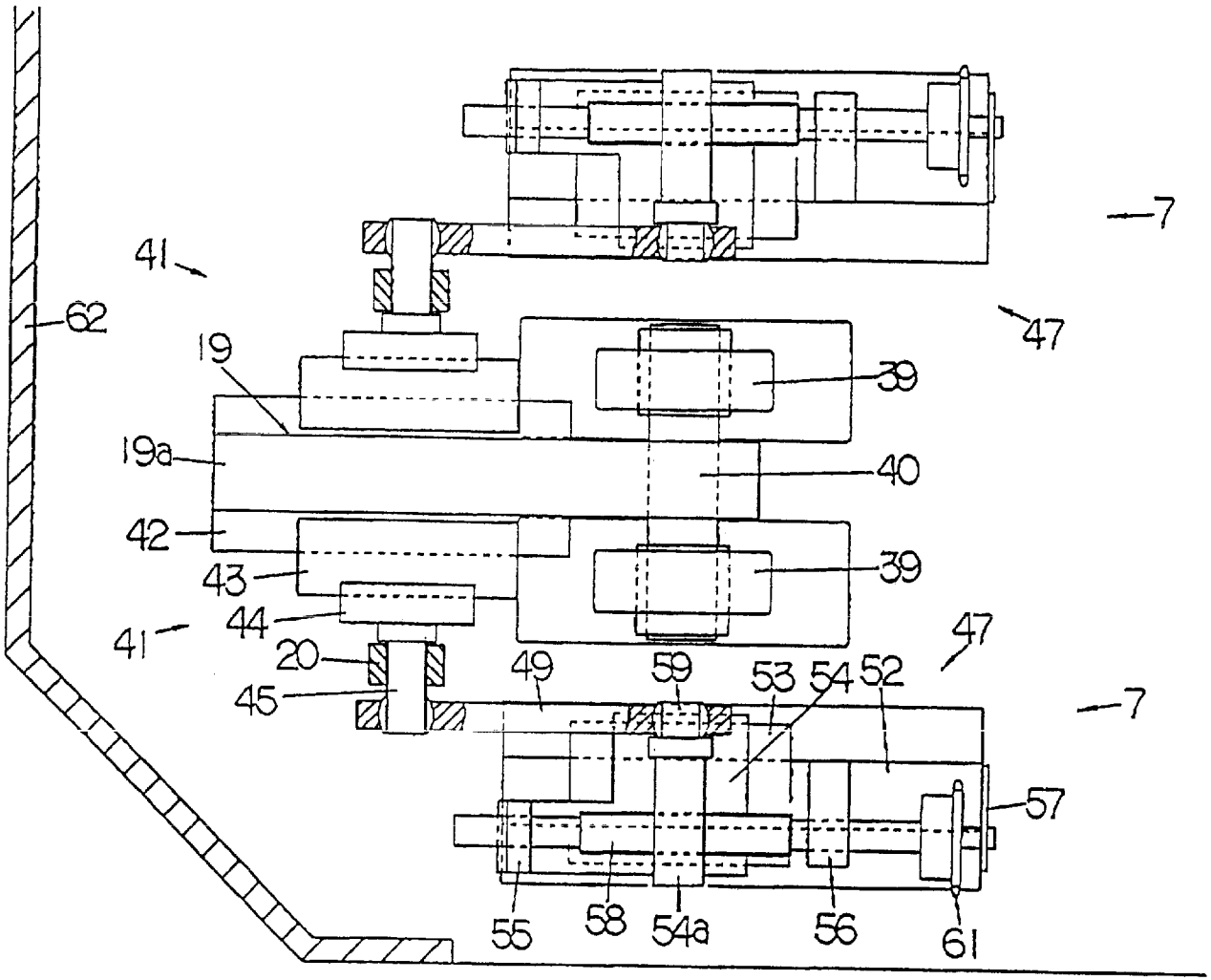
FIG. 5 is a top view of the filling amount fine adjustment assemblies.

As shown in FIGS. 1, 4, and 5, the swing arm 19 is supported by a bearing 39 fastened to an attachment base 38 of the machine base bottom plate 4 so that the swing arm 19 pivots about a horizontal supporting shaft 40. Two first sliding units 41 which are parts of the fine adjustment assembly 7 are disposed on the arm 19*a* located on the filling section side. Each of these first sliding units 41 is comprised of a slide rail 42 which is fastened to one side (one slide rail on each side) of the arm 19*a* in the direction of length of the arm 19*a,* a sliding block 43 which slides on the slide rail 42, a first sliding member 44 which is fastened to the sliding block 43, and a connecting pin 45 which is fastened to the first sliding member 44. The connecting member 20 is pivotally attached to the connecting pin 45 at one end thereof and is also pivotally connected to the piston rod 14 at another end via a connecting pin 46.

Figure 6:
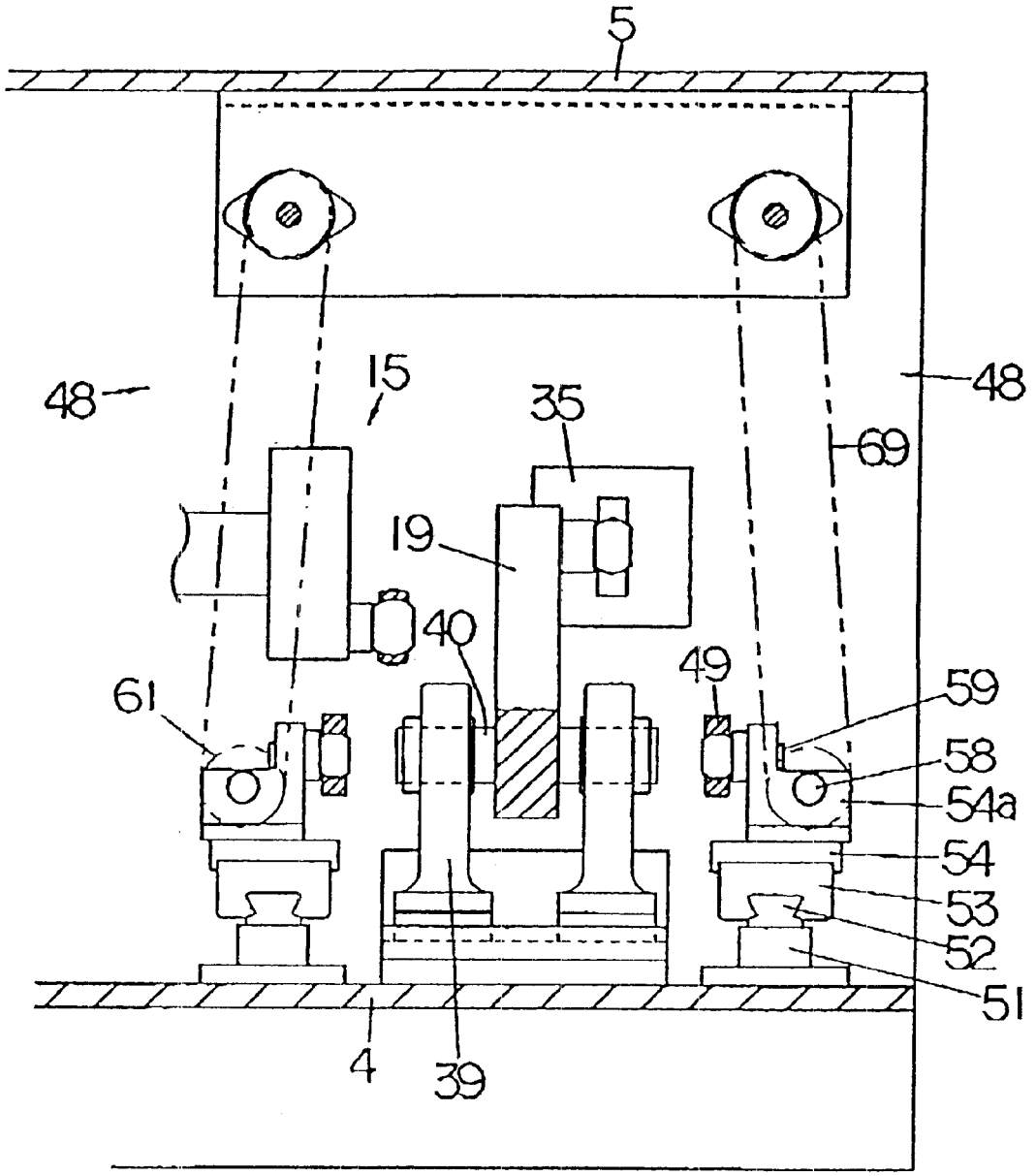
FIG. 6 is a front view of the second sliding units of the filling amount fine adjustment assemblies.
Figure 7:
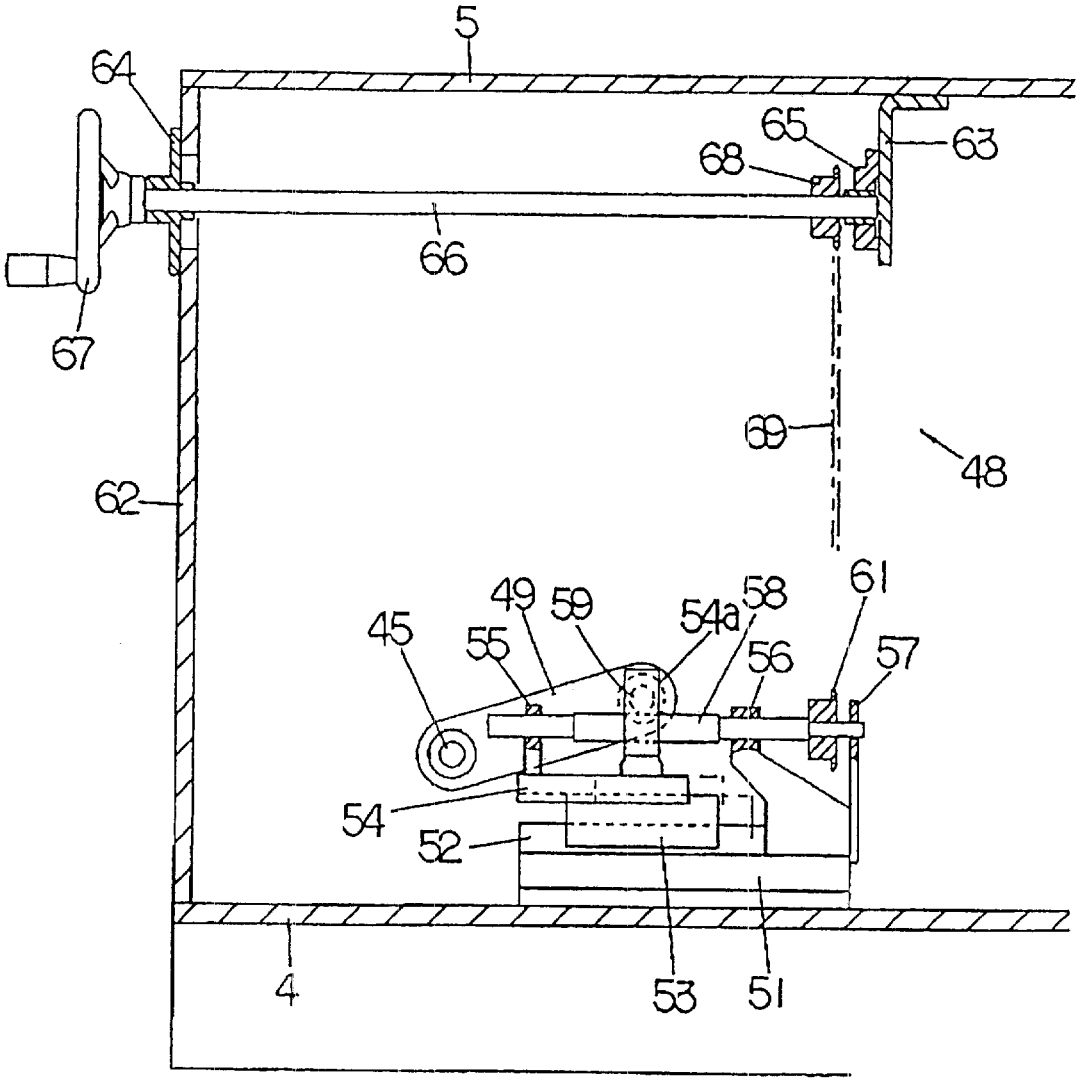
FIG. 7 is a side view, in cross section, of the operating section of the filling amount fine adjustment assembly.

As seen from FIGS. 5 through 7, the fine adjustment assembly 7 is comprised of, together with other elements, the two first sliding units 41, two second sliding units 47 which are disposed on the machine base bottom frame 4 on both (the left and right) sides of the swing arm 19, and operating sections 48 of the respective second sliding units 47. The fine adjustment assembly 7 further includes connecting links 49 which are connected to the second sliding units 47 and the first sliding members 44.

Each one of the two second sliding units 47 is comprised of, together with other elements, an attachment base 51, a slide rail 52 attached to the upper surface of the attachment base 51, and a sliding block 53 that slides in the horizontal plane on the slide rail 52. Each second sliding unit 47 further includes a second sliding member 54 which is fastened to the sliding block 53 and in which a female screw is formed so as to be parallel to the slide rail 52. A fine adjustment shaft 58 of the second sliding unit 47 is rotatably supported by bearings 55 through 57, and a male screw that engages with the female screw of the second sliding member 54 is formed on the fine adjustment shaft 58. In addition, a connecting pin 59 is fastened to the second sliding member 54. The portion of the second sliding member 54 on which the female screw is formed and to which the connecting pin 59 is fastened is the upper half portion 54*a* of the second sliding member 54. Further, the bearing 55 is disposed on the second sliding member 54, and the bearings 56 and 57 are disposed on the attachment base 51.

In each second sliding unit 47, the orientation of the slide rail 52 (i.e., the sliding direction of the second sliding member 54) is a direction that is at right angles to the supporting shaft 40 of the swing arm 19. The slide rail 52 is set in a direction that runs more or less along the orientation of the portion 19*a* of the swing arm 19 that is located on the filling section side. Since the arm 19 swings through a specified angle, the orientation of the portion 19*a* is not a single fixed direction.

As seen from FIGS. 6 and 7, the operating section 48 of each second sliding unit 47 is comprised of, together with other elements, a sprocket 61 which is attached to the fine adjustment shaft 58, a handle shaft 66 and handle 67 which are supported by the base side plate 62 and attachment plate 63 via bearings 64 and 65 so that the handle shaft 66 and handle 67 are rotatable, a sprocket 68 which is attached to the handle shaft 66, and a chain 69 mounted between the sprockets 61 and 68.

Furthermore, one end of the connecting link 49 is pivotally connected to the first sliding member 44 via the connecting pin 45. Another end of the connecting link 49 is pivotally attached to the second sliding member 54 via the connecting pin 59. The connecting link 49 is the position regulating member of the present invention.

With the above structure, the driving force from the crank driving section 2 is transmitted via the rough adjustment assembly 6 and transmission control section 18 so that when the swing arm 19 swings, the first sliding member 44 swings at the same time. In this case, the first sliding member 44 is regulated by the connecting link 49 and swings along a circular-arc-form path about the connecting pin 59 that is on the second sliding member 54 side. As seen from FIGS. 5 and 6, in cases where the axial center of the connecting pin 59 is on an extension (or on an imaginary extended line) of the axial center of the supporting shaft 40 of the swing arm 19, the first sliding member 44 does not move on the slide rail 42.

Here, when the handle 67 is rotated in either direction, the fine adjustment shaft 58 is rotated via the sprocket 68, chain 69 and sprocket 61, so that the second sliding member 54 slides on the slide rail 52. At the same time, the first sliding member 44 slides on the slide rail 42 via the connecting pin 59, connecting link 49 and connecting pin 45, so that the position of the first sliding member 44 in the direction of length of the arm is adjusted. As a result, the swing distance of the connecting pin 45 attached to the first sliding member 44, i.e., the raising-and-lowering distance of the piston rod 14 is changed, so that the filling amount is altered (adjusted). Needless to say, this adjustment of the filling amount can be performed independently for the two fine adjustment assemblies.

When the axial center of the connecting pin 59 is caused to deviate from the extension of the supporting shaft 40 of the swing arm 19 as a result of the above adjustment, the first sliding member 44 constantly slides back and forth on the slide rail 42 as the swing arm 19 swings. Generally, in order to reduce the amount of slide during this operation, it is preferable to dispose the second sliding units 47 so that the connecting pins 59 are located as close as possible to the positions on the left and right sides of the supporting shaft 40 (or to the positions on both sides of the supporting shaft 40) (see FIG. 5). In other words, it is preferable that the movement path of the axial center of each connecting pin 59 caused by the movement of the corresponding second sliding member 54 pass through position that are on the extensions of the axial center of the supporting shaft 40. It is also preferable that the direction of movement of each second sliding member 54 be set in a direction that runs more or less along the orientation of the portion 19*a* of the swing arm 19 that is located on the side of the filling section.

Figure 9:
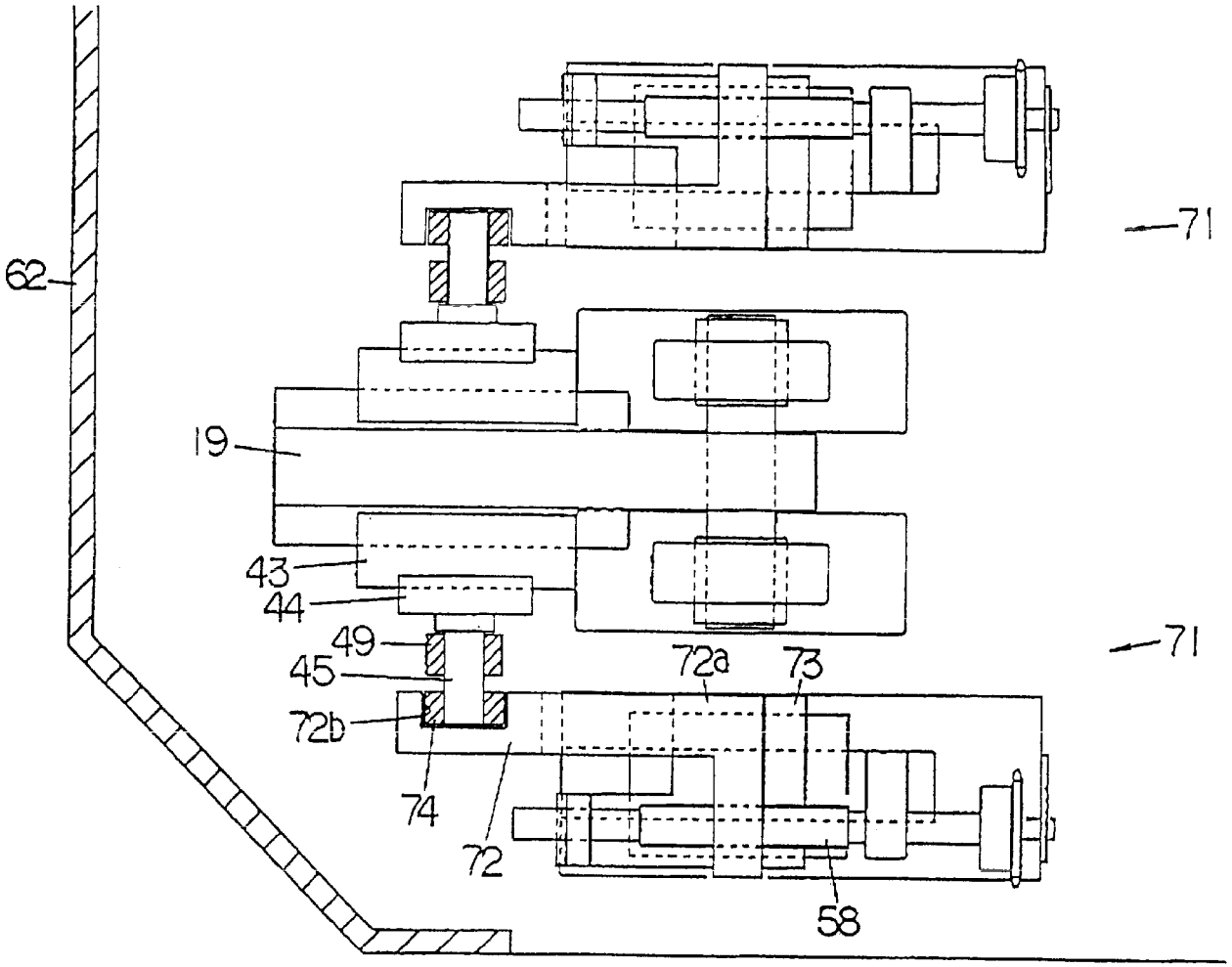
FIG. 9 is a top view of another filling amount fine adjustment assembly of the present invention.
Figure 10:
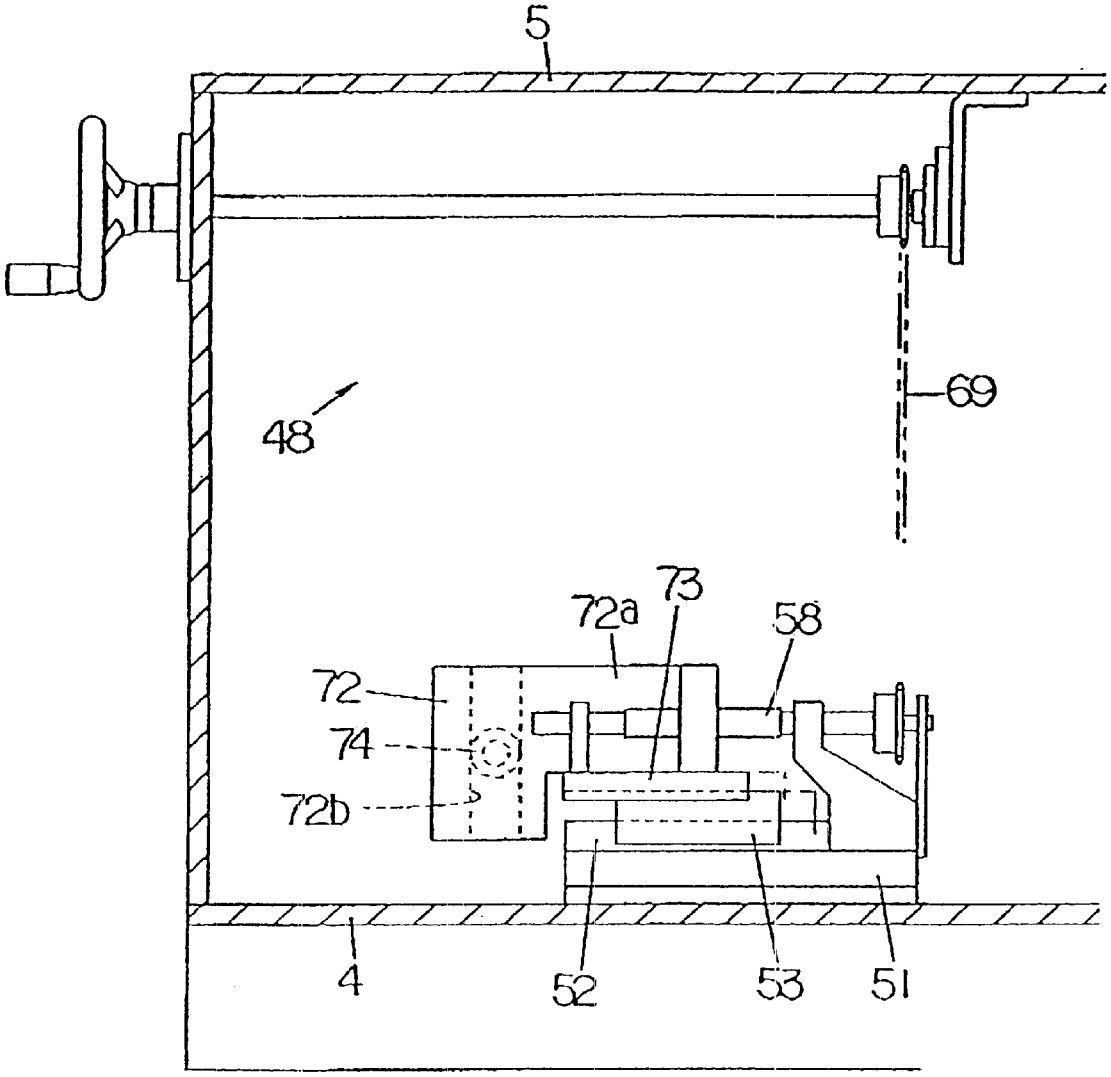
FIG. 10 is a side view of the grooved cam of the filling amount fine adjustment assembly.

Another fine adjustment assembly 71 of the present invention will be described with reference to FIGS. 9 and 10 (the constituent elements which are the same as those of the fine adjustment assembly 7 are labeled with the same symbols).

This fine adjustment assembly 71 differs from the fine adjustment assembly 7 in that the elements that correspond to the position regulating members (i.e., the connecting links 49 in the case of the fine adjustment assembly 7) are grooved cams 72. Each one of the grooved cams 72 is attached to the corresponding second sliding member 73 at its attachment portion 72*a*. A cam roller 74 that is attached to the connecting pin 45 of the corresponding first sliding member 44 rolls in the groove 72*b* of the grooved cam 72. In other words, each grooved cam 72 is connected to the corresponding first sliding member 44 via the cam roller 74. A female screw is formed in one end of the attachment portion 72*a,* and a fine adjustment shaft 58 is engaged with this female screw.

In this fine adjustment assembly 71, when the swing arm 19 swings and the first sliding member 44 swings at the same time, the path of this swing movement is regulated by the corresponding grooved cam 72, and this path runs along the groove 72*b* of the grooved cam 72. In a case where each groove 72*b* is formed in a straight line as shown in FIG. 10, the first sliding member 44 constantly slides back and forth along the slide rail 42 as the swing arm 19 swings. In order to reduce the amount of slide during this operation, the grooves 72*b* can be formed with a circular-arc shape, and the second sliding units 47 can be disposed so that the centers of the grooves 72*b* are disposed near positions on left and right extensions of the axial center of the supporting shaft 40 (or on both sides of the supporting shaft 40). In this case, it is preferable that the paths of the movement of the centers of the circular arcs caused by the movement of the second sliding members 73 pass through positions on extensions of the axial center of the supporting shaft 40. It is also preferable that the direction of movement of the second sliding members 73 be set in a direction that runs more or less along the orientation of the portion 19*a* of the swing arm 19 that is located on the side of the filling section.

In the above liquid-form substance filling machine, one rough adjustment assembly 6 is interposed in the driving force transmission section 3 on the crank driving section 2 side, and two fine adjustment assemblies 7 are disposed on the filling section 1 side, thus establishing a two-unit machine. Rough adjustment is performed simultaneously for the two filling sections, and fine adjustment is performed separately for the respective filling sections (even in cases where the respective filling sections have the same structure, there is some variation in the filling amount, so that separate adjustment may be necessary). Accordingly, the working efficiency of the adjustment of the filling amount is high, and at the same time, accurate adjustment is performed separately. In particular, since both rough adjustment and fine adjustment can be performed during the operation of the filling machine, adjustments are accomplished more accurately and efficiently.

Furthermore, the fine adjustment assemblies 7 and 71 do not require a large installation space, and the moving elements are not bulky. Accordingly, a plurality of units can easily be disposed inside the machine base. Thus, the present invention is suitable for use in a multi-unit filling machine. Moreover, the weight of the moving elements can be down even in the case of a multi-unit machine, so that the load on the crank driving section 2 and driving force transmission section 3 is small. In the embodiments above, two fine adjustment assemblies are provided on one arm 19. However, it is possible to install three or more fine adjustment assemblies on the arm 19.

In addition, in the above fine adjustment assemblies 7 and 71, the second sliding members 54 are caused to slide manually by the handle 67. However, it is possible to slide and position the second sliding members 54 by, for instance, way of driving the fine adjustment shafts 58 by means of servo motors. Furthermore, in the above-described filling machine, the filling amount adjustment device is divided into a rough adjustment assembly and a fine adjustment assembly, and the filling amount is adjusted using both of these adjustment assemblies. However, it is possible to adjust the filling amount by installing only fine adjustment assemblies with the rough adjustment assembly omitted.

As seen from the above, the filling amount adjustment device of the present invention adjusts the filling amount even during the operation of the filling machine. Furthermore, the present invention provides a filling amount adjustment device that does not require a large installation space even when the device is used in a multi-unit packaging machine. In addition, only a small amount of the load is applied on the drive section and driving force transmission section.

We claim:

1. A filling amount adjustment device for a liquid-form substance filling machine, wherein in said liquid-form substance filling machine a piston rod is caused to advance and retract by an arm that is connected to a drive section and makes a swing movement, a piston is caused to advance and retract inside a filling cylinder by said piston rod, a predetermined amount of a liquid-form substance is supplied into said filling cylinder, and said liquid-form substance is discharged from said filling cylinder and then released out of a filling nozzle, and wherein said filling amount adjustment device is comprised of:

a first sliding member provided on said arm so that said first sliding member swings together with said arm and slides in a direction of length of said arm, said first sliding member being connected to said piston rod via a connecting member, a second sliding member that slides in a direction perpendicular to a supporting shaft of said arm and stops at appropriate positions, and a position regulating member which is provided on said second sliding member and is moved by a sliding movement of said second sliding member, said position regulating member being connected to said first sliding member and guiding a swing movement of said first sliding member along a predetermined path, and wherein a position of said first sliding member with respect to said direction of length of said arm is adjusted by way of sliding said second sliding member and thus moving said position regulating member.

2. The filling amount adjustment device for a liquid-form substance filling machine according to claim 1, wherein said position regulating member is a connecting link, one end of said connecting link is pivotally connected to said first sliding member, and another end of said connecting link is pivotally attached to said second sliding member.

3. The filling amount adjustment device for a liquid-form substance filling machine according to claim 1, wherein said position regulating member is a grooved cam and is connected to said first sliding member via a cam roller that rolls in a groove of said grooved cam.

4. The filling amount adjustment device for a liquid-form substance filling machine according to claim 1, 2 or 3, wherein said filling amount adjustment device is applied to a liquid-form substance filling machine that is provided with a plurality of filling cylinders and filling nozzles, a plurality of said first sliding members are provided on a single arm, said second sliding members and position regulating members are provided so as to respectively correspond to said first sliding members, and a plurality of said second sliding members are provided so as to be individually positioned.

5. A liquid-form substance filling machine wherein a piston rod is caused to advance and retract by an arm that is connected to a drive section and makes a swing movement, a piston is caused to advance and retract inside a filling cylinder by said piston rod, a predetermined amount of a liquid-form substance is supplied into said filling cylinder, and said liquid-form substance is discharged from the filling cylinder and then released out of a filling nozzle, said liquid-form substance filling machine comprising:

the filling amount adjustment device according to claim 1, 2 or 3, and a filling amount adjustment device provided in a driving force transmission section installed between said drive section and said arm, said filling amount adjustment device adjusting a swing angle of said arm.

6. A liquid-form substance filling machine wherein a piston rod is caused to advance and retract by an arm that is connected to a drive section and makes a swing movement, a piston is caused to advance and retract inside a filling cylinder by said piston rod, a predetermined amount of a liquid-form substance is supplied into said filling cylinder, and said liquid-form substance is discharged from the filling cylinder and then released out of a filling nozzle, said liquid-form substance filling machine comprising:

the filling amount adjustment device according to claim 4, and a filling amount adjustment device provided in a driving force transmission section installed between said drive section and said arm, said filling amount adjustment device adjusting a swing angle of said arm.

* * * * *